US008159119B2

(12) United States Patent
Kim et al.

(10) Patent No.: US 8,159,119 B2
(45) Date of Patent: Apr. 17, 2012

(54) VACUUM CHANNEL TRANSISTOR AND MANUFACTURING METHOD THEREOF

(75) Inventors: Dae Yong Kim, Daejeon (KR); Hyun Tak Kim, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 373 days.

(21) Appl. No.: 12/241,182

(22) Filed: Sep. 30, 2008

(65) Prior Publication Data

US 2009/0140626 A1 Jun. 4, 2009

(30) Foreign Application Priority Data

Nov. 30, 2007 (KR) ..... 10-2007-0123121
Mar. 6, 2008 (KR) ..... 10-2008-0021064

(51) Int. Cl.
*H01J 63/04* (2006.01)

(52) U.S. Cl. ..... 313/311

(58) Field of Classification Search ..... 313/309–311
See application file for complete search history.

(56) References Cited

U.S. PATENT DOCUMENTS 4,827,177 A 5/1989 Lee et al.
5,012,153 A 4/1991 Atkinson et al.
5,223,766 A * 6/1993 Nakayama et al. ..... 313/495
6,172,456 B1 * 1/2001 Cathey et al. ..... 313/495
6,727,642 B1 * 4/2004 Cho et al. ..... 313/496

FOREIGN PATENT DOCUMENTS

KR 1999-0077953 10/1999
KR 1999-0077954 10/1999
KR 2001-0045181 6/2001
KR 10-2008-0093689 10/2008

OTHER PUBLICATIONS

"Field emission properties of diamond-like carbon films annealed at different temperatures", J.J. Li et al., Applied Surface Science 251 (2005) 236-241, vol. 251, pp. 236-241.
"Low-macroscopic field emission from silicon-incorporated diamond-like carbon film synthesized by dc PECVD", Sk.F. Ahmed et al., Applied Surface Science 253 (2007) 5480-5484, vol. 253, pp. 5480-5484.

* cited by examiner

*Primary Examiner* — Toan Ton
*Assistant Examiner* — Hana Featherly
(74) *Attorney, Agent, or Firm* — Rabin & Berdo, P.C.

(57) ABSTRACT

Disclosed are a vacuum channel transistor including a planar cathode layer formed of a material having a low work function or a planar cathode layer including a heat resistant layer formed of a material having a low work function, and a manufacturing method of the same. In the vacuum channel transistor, electrons can be emitted even when a low voltage is applied to a gate layer, a voltage of an anode layer has a small influence on electron emission of a cathode layer, and instability of emission current is obviated. Accordingly, high efficiency and a long lifespan can be achieved, and thus operational stability is secured.

13 Claims, 7 Drawing Sheets

VACUUM CHANNEL TRANSISTOR AND MANUFACTURING METHOD THEREOF

CROSS-REFERENCE TO RELATED APPLICATIONS

This application claims the priority of Korean Patent Application No. 2007-123121 filed on Nov. 30, 2007, and Korean Patent Application No. 2008-21064 filed on Mar. 6, 2008 in the Korean Intellectual Property Office, the disclosure of which is incorporated herein by reference.

BACKGROUND OF THE INVENTION

1. Field of the Invention

The present invention relates to a vacuum channel transistor and a manufacturing method thereof, and more particularly, to a vacuum channel transistor including a planar cathode layer formed of a material having a low work function or a planar cathode layer including a heat resistant layer formed of a material having a low work function, and a method of manufacturing the same.

2. Description of the Related Art

In a related art Spindt type vacuum channel transistor, when a high voltage is applied between the cathode electrode and a gate electrode, electrons are emitted through a surface of a pointed metal micro-tip of a cathode electrode. The emitted electrons are accelerated to reach the anode electrode by a voltage being applied to the anode electrode. In such a manner, a current flows in the related art Spindt type vacuum channel transistor.

In general, a voltage of 0.5 V/Å or higher must be applied between the cathode and anode electrodes in order to emit sufficient free electrons from a metal surface in a vacuum. A spindt type cold cathode electrode emits electrons through field emission. For this emission of electrons, an electric field must be about $10^9$ V/m or higher at a surface of the cold cathode electrode from which electrons are emitted.

The intensity of the electric field at the surface of the cathode electrode is defined as a value obtained by dividing a voltage between the cathode electrode and the anode electrode by a distance between the cathode and anode electrodes. Thus, in the case of using flat electrodes, to form an electric field of about $10^9$ V/m between the electrodes, a voltage of about $10^6$ V must be applied between the electrodes if the distance between the electrodes is about 1 mm. Also, even if the distance between the electrodes is about 1 μm, a voltage of about 1,000 V or higher must be applied.

In actuality, to achieve the electric field of about $10^9$ V/m, a pointed micro-tip which is formed of metal such as silicon, molybdenum or tungsten is used. Due to geometrical effects of the micro-tip, the intensity of an electric field is high at an end of the micro-tip. Thus, by using the micro-tip, electrons can be emitted at a lower voltage than in the case of the flat electrodes.

However, the related art vacuum channel transistor including the metal micro-tip has the following limitations.

Ion sputtering and the like during an operation of the related art vacuum channel transistor may easily cause damage to the metal micro-tip. The damage to the metal micro-tip causes unstable operations of the vacuum channel transistor.

A process of forming uniform metal micro-tips having pointed shapes is very difficult. This significantly affects the image uniformity of a display device that adopts such vacuum channel transistors having the metal micro-tips.

In addition, since arc discharge is caused by a high electric field between the gate electrode and the micro-tip, the gate electrode and the micro-tip may be easily damaged. In actuality, the degree of vacuum of the related art vacuum channel transistor may be lowered during a processing process or an operation of the transistor, and an interval between electrodes is very short. For this reason, when impurities such as metal atoms are deposited between the electrodes, the arc discharge may easily occur, causing damage to the gate electrode or the micro-tip.

SUMMARY OF THE INVENTION

An aspect of the present invention provides a vacuum channel transistor including a planar cathode layer formed of a material having a low work function or a planar cathode layer including a heat resistant layer formed of a material having a low work function.

According to an aspect of the present invention, there is provided a vacuum channel transistor including: an upper structure including an anode layer disposed on a bottom surface of an upper substrate; and a lower structure including a cathode layer and a gate layer spaced apart from a top surface of a lower substrate, and a cavity provided between the lower substrate and the cathode layer, the cathode layer being formed of a material having a low work function.

The vacuum channel transistor may further include a spacer supporting the upper structure and the lower structure to be spaced apart from each other.

The cathode layer may include a local-heating microelectrode part provided by etching a portion of the cathode layer to form a step with the cathode layer. The local-heating microelectrode part may have a structure in which grooves are recessed alternately from one side and from the other side of the cathode layer.

The vacuum channel transistor further may include a heat resistant layer formed of a material having a low work function on the cathode layer. The material having a low work function is one selected from the group consisting of diamond, diamond-like carbon (DLC) and barium oxide.

The vacuum channel transistor may further include at least one control gate layer spaced apart from a top portion of the gate layer.

According to another aspect of the present invention, there is provided a manufacturing method of a vacuum channel transistor, the method including: forming an anode layer on a bottom surface of an upper substrate to form an upper structure; forming a cathode layer and a gate layer to be spaced apart from a top surface of a lower substrate to form a lower structure; forming a cavity between the lower substrate and the cathode layer; and coupling the upper structure with the lower structure to be spaced apart from each other. The cathode layer may be formed of a material having a low work function.

The method of claim may further include at least one of operations of etching a portion of the cathode layer to form a local-heating microelectrode part forming a step with the cathode layer, forming a heat resistant layer of a material having a low work function on the cathode layer, and forming at least one control gate layer to be spaced apart from a top surface of the gate layer.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Figure 1:
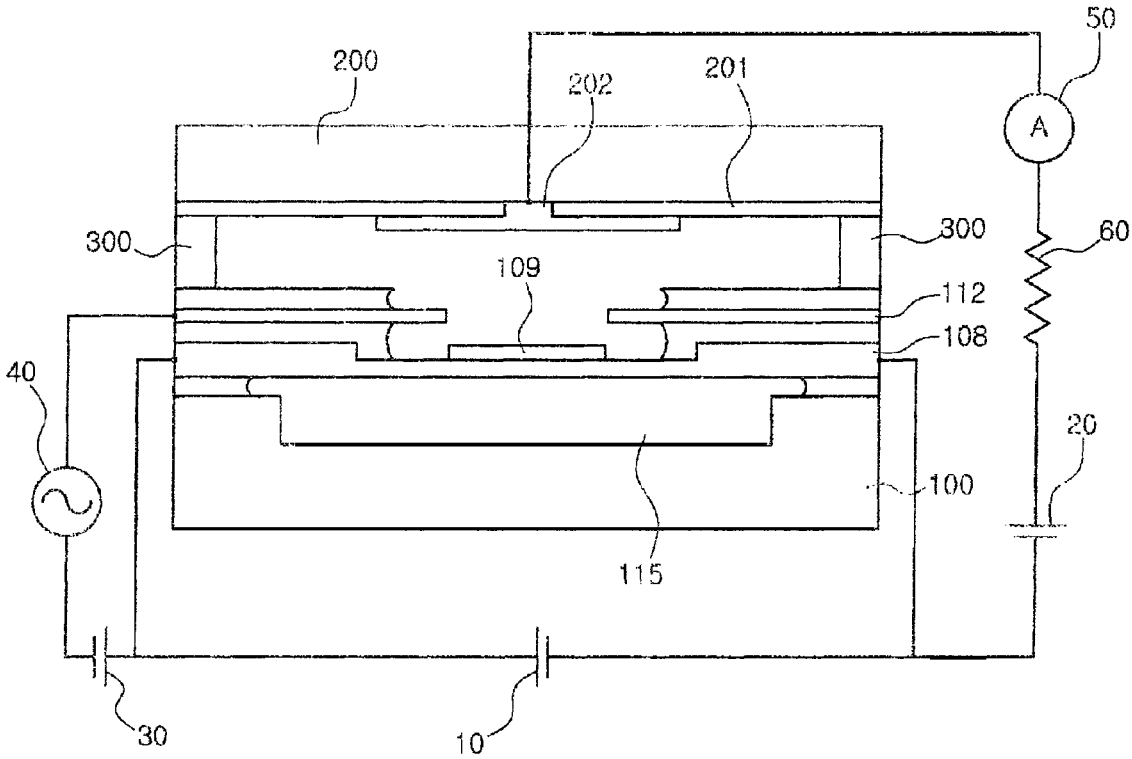
FIG. 1 is a view for explaining a structure and an operation method of a vacuum channel transistor according to an exemplary embodiment of the present invention.

Exemplary embodiments of the present invention will now be described in detail with reference to the accompanying drawings. Like reference numerals refer to like elements throughout. In some embodiments, well-known processes, device structures, and technologies will not be described in detail to avoid ambiguousness of the present invention.

FIG. 1 is a view for explaining a structure and an operation method of a vacuum channel transistor according to an exemplary embodiment of the present invention. The vacuum channel transistor includes an upper structure and a lower structure. The upper structure includes an anode layer 202 disposed on a bottom surface of an upper substrate 200. The lower structure includes a cathode layer 108 and a gate layer 112 spaced apart from a top surface of a lower substrate 100, and a cavity 115 placed between the lower substrate 100 and the cathode layer 108. The vacuum channel transistor may further include a spacer 300 supporting the upper and lower structures to be spaced from each other, and a heat resistant layer 109 disposed on the cathode layer 108.

Referring to FIG. 1, when a voltage from a power source 30 is applied between the gate layer 112 and the cathode layer 108, electrons are emitted from the cathode layer 108. The emitted electrons are transferred to the anode layer 202 by an electric field generated by a potential difference caused by a voltage applied from a power source 20 between the anode layer 202 and the cathode layer 108. The gate layer 112 includes an electron passing region allowing the electrons emitted from the cathode layer 108 to reach the anode layer 202. The electron passing region means a form of a gate layer allowing electron transfer between the cathode layer 108 and the anode layer 202. For example, the gate layer 112 may include a positive potential region having a positive potential so that electrons can be transmitted from the cathode layer 108 to the anode layer 202 through the positive potential region. Alternatively, one or more control gate layers 116 and 118 (see FIG. 2D) spaced apart from a top portion of the gate layer 112 may be further provided.

In general, an electric field of $10^9$ V/m or higher is needed to emit electrons within a general metal to a vacuum. The general metal is a pure metal having a work function of about 3 eV to about 5 eV. However, when diamond or diamond-like carbon (DLC) having a lower work function is used, a current of similar magnitude to that of the general metal can be achieved even at an electron field of just about $10^7$ V/m to about $10^8$ V/m. Therefore, by forming the cathode layer 108 of such a material having a low work function, a thermal electron emission type transistor that can operate at a low voltage can be manufactured.

A current density of electrons emitted from the metal to the vacuum may be calculated according to the Fowler-Nordheim equation expressed by Equation 1 below:

$$J=aV^2\exp(-b/V)[A/\mathrm{cm}^2]$$

where $a=1.5\times10^{-6}(A/\psi)\exp(10.4/\psi^{1/2})b$, $b=6.44\times107\psi^{3/2}/b$, V represents a potential difference, A represents an emission area ($cm^2$), ψ represents a potential difference (eV) corresponding to a work function of a metal, and b represents a geometric factor depending on a structure of an electrode.

In the vacuum channel transistor, the magnitude of a current is determined by the electrons emitted from the cathode layer 108. The amount of electrons being emitted varies according to the intensity of an electric field at an edge of the cathode layer 108 adjacent to the gate layer 112, and the magnitude of a work function of a metal constituting the cathode layer 108. Therefore, to obtain high current density, the intensity of the electric field must be increased by reducing a radius of curvature of an edge of the cathode layer 108 and increasing a voltage between the cathode layer 108 and the gate layer 112.

As described above, if the cathode layer 108 is formed of a material having a low work function such as diamond or DLC, a desired current density may be obtained even at a relatively low electric field. Alternatively, the cathode layer 108 may be formed of a conductor having high conductivity such as platinum, and the heat resistant layer 109 of a material having a low work function may be disposed on the cathode layer 108.

Also, the current density can be increased by heating the cathode layer 108 directly or indirectly and thus increasing the amount of electrons being emitted from the cathode layer 108. This is because as the temperature of the cathode layer 108 increases, electrons in covalent bonding gain energy and thus their tendency to become free electrons is enhanced. As a result, more electrons can be emitted at a lower gate voltage.

To lower an emission temperature of thermal electrons, a local-heating microelectrode part is provided by etching a portion of the cathode layer 108 to form a step with a portion of the cathode layer 108 which is not etched. The heat resistant layer 109 of a material having a low work function such as DLC and barium oxide is disposed on the local-heating microelectrode part. When current flows in the local-heating microelectrode part as a voltage from a power source 10 is applied thereto, a temperature thereof increases. This increase in temperature of the local-heating microelectrode part causes the entire temperature of the cathode layer 180 to increase. Accordingly, emission of electrons is facilitated from the heat resistant layer 109 placed on the cathode layer 108.

The cathode layer 108 and the lower substrate 100 may be spaced apart from each other, so that the local-heating microelectrode part does not conduct heat directly to a portion besides the cathode layer 108.

Figure 2A:
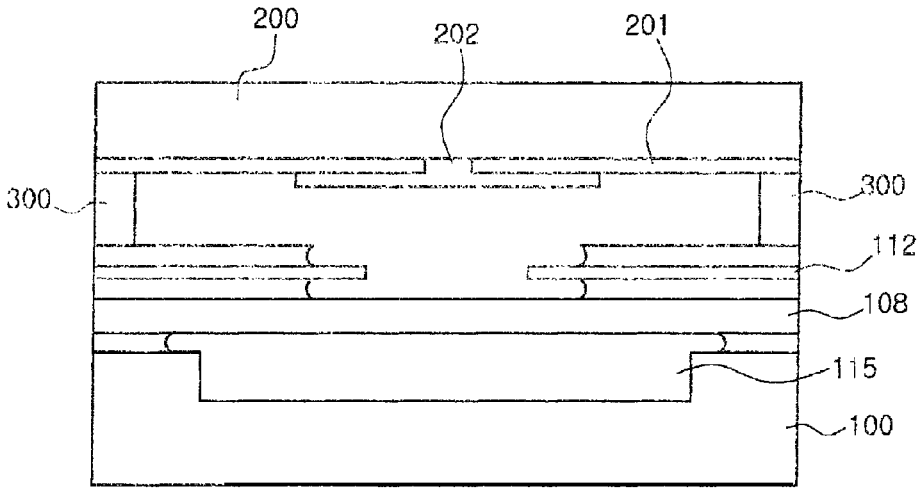
FIGS. 2A through 2D are cross-sectional views of vacuum channel transistors according to various exemplary embodiments of the present invention.
Figure 2B:
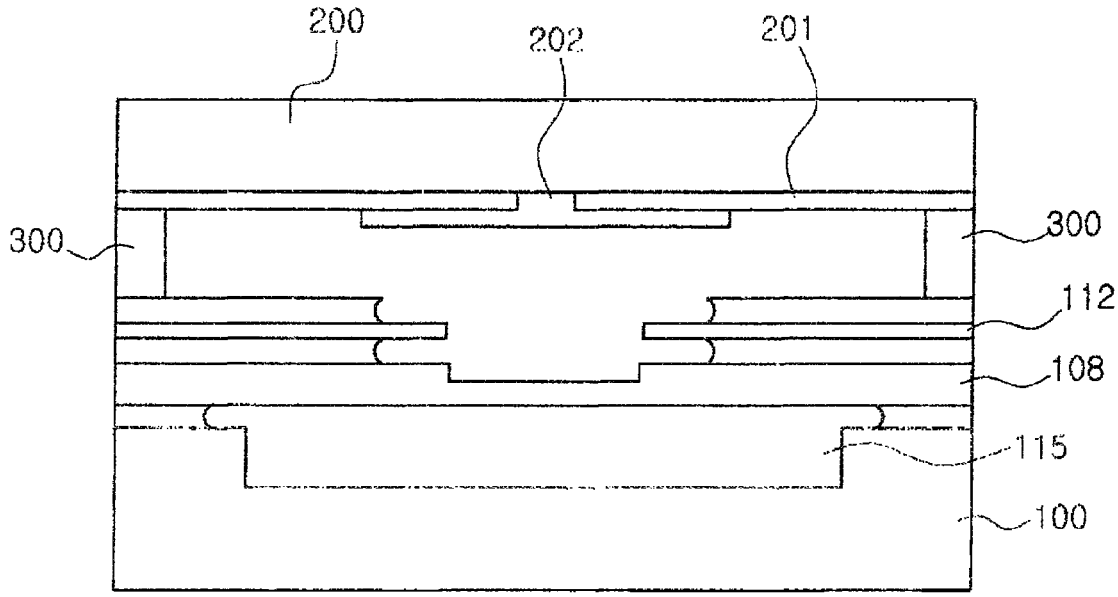
Figure 2C:
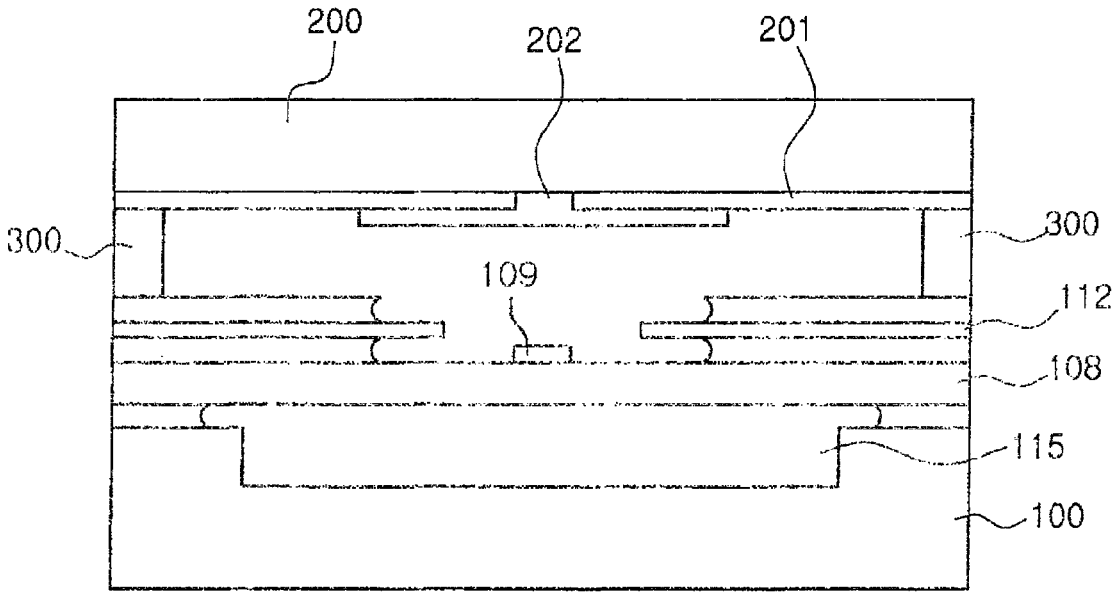
Figure 2D:
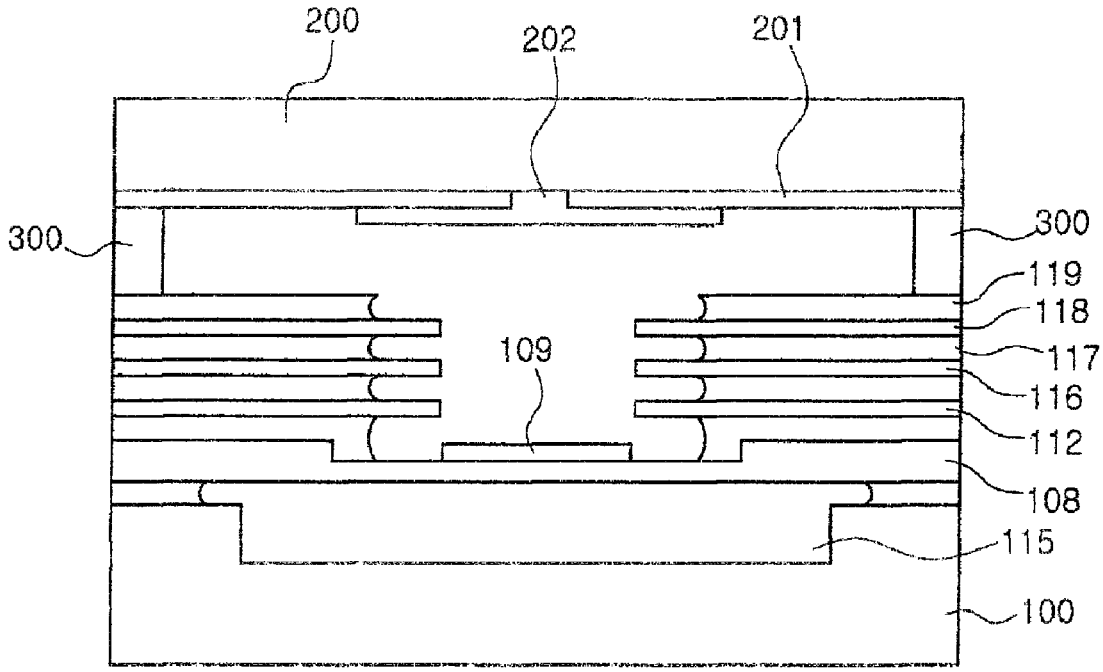

FIGS. 2A and 2D are cross-sectional views of vacuum channel transistors according to various exemplary embodiments of the present invention.

FIG. 2A is a cross-sectional view of a vacuum channel transistor including a planar cathode layer 108 formed of a material having a low work function. If the cathode layer 108 is formed of the material having a low work function, the vacuum channel transistor can emit electrons even at a low voltage.

FIG. 2B is a cross-sectional view illustrating that a local-heating microelectrode part is provided by etching a portion of the cathode layer 108 of the vacuum channel transistor of FIG. 2A to form a step with the cathode layer 108. As mentioned above, the cathode layer 108 is formed of a material having a low work function, and heating of the cathode layer 108 is facilitated because of the local-heating microelectrode part.

FIG. 2C is a cross-sectional view illustrating that a heat resistant layer 109 formed of a material having a low work function is further provided on the cathode layer 108 of the vacuum channel transistor of FIG. 2A. The cathode layer 108 may be formed of a conductor having high conductivity such as platinum, or a material having a low work function.

FIG. 2D is a cross-sectional view illustrating that first and second control gate layers 116 and 118 are further provided in the vacuum channel transistor of FIG. 1. As shown in FIG. 2D, a vacuum channel transistor according to an exemplary embodiment of the present invention may further include one or more control gate layers 116 and 118 on the gate layer 112 in order to improve linearity of an I-V characteristic curve of the vacuum channel transistor. Third and fourth insulating layers 117 and 119 are placed between the control gate layer 116 and the gate layer 112 or between the control gate layers 116 and 118, so that the gate layers are spaced apart from each other.

Figure 3:
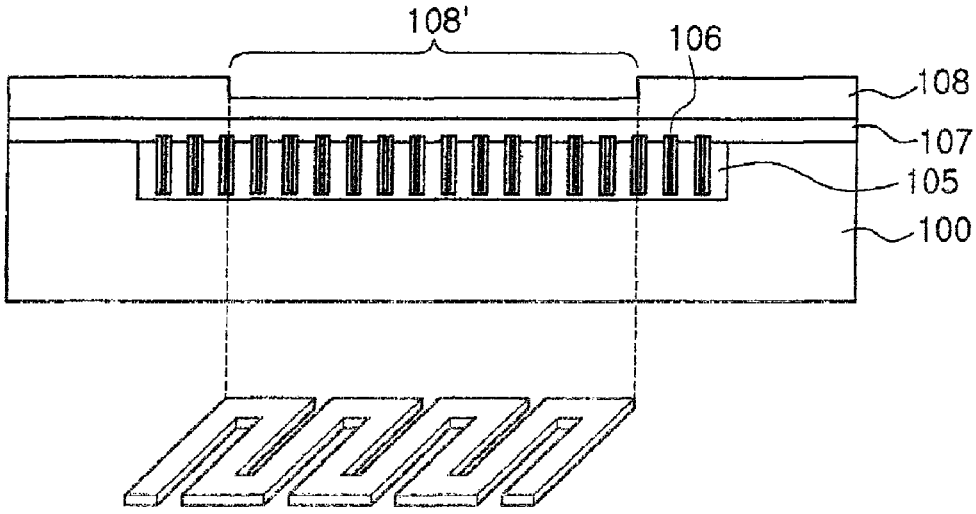
FIG. 3 is a view for explaining a structure of a local-heating microelectrode part included in a cathode layer of a vacuum channel transistor, according to an exemplary embodiment of the present invention.

FIG. 3 is a view for explaining a structure of a local-heating microelectrode part included in a cathode layer of a vacuum channel transistor, according to an exemplary embodiment of the present invention.

A local-heating microelectrode part 108' provided by etching a portion of the cathode layer 108 may have a structure as illustrated in FIG. 3. The local-heating microelectrode part 108' having the structure as illustrated in FIG. 3 may be provided by etching a portion of the cathode layer 108 and then forming grooves alternately from one side and from the opposite side in the etched portion. Because of the local-heating microelectrode part 108' having the above structure, a resistance is low at an edge portion of the cathode layer 108 and is high at a central portion of the cathode layer 108, i.e., a portion corresponding to the local-heating microelectrode part 108'. Thus, heat conduction to a silicon bulk portion becomes slow while local heating is facilitated. The local-heating microelectrode part 108' may perform local heating up to about 400° C. to about 600° C. by using platinum (Pt) which is a conductive material or polysilicon doped to have a resistance of about 10 Ω/square.

Figure 4A:
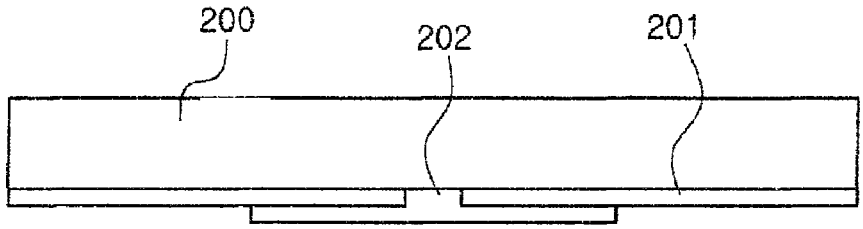
FIGS. 4A through 4N are cross-sectional views for explaining a process of manufacturing a vacuum channel transistor according to an exemplary embodiment of the present invention.
Figure 4B:
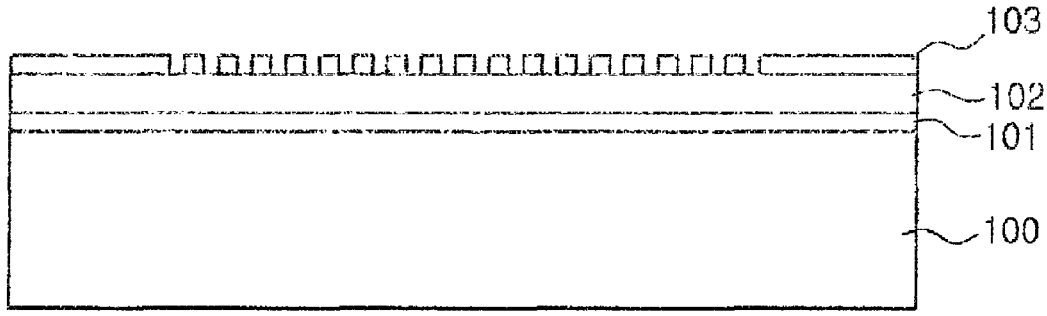
Figure 4C:
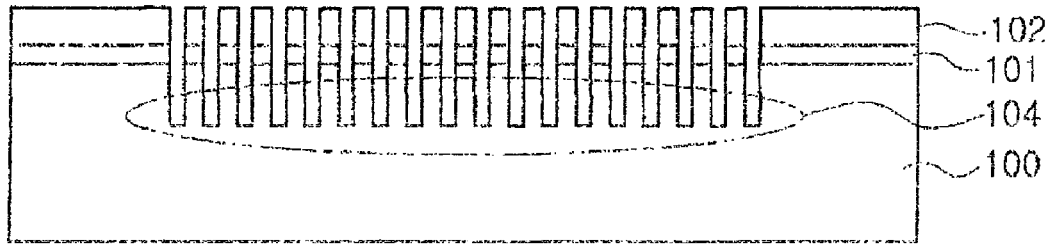
Figure 4D:
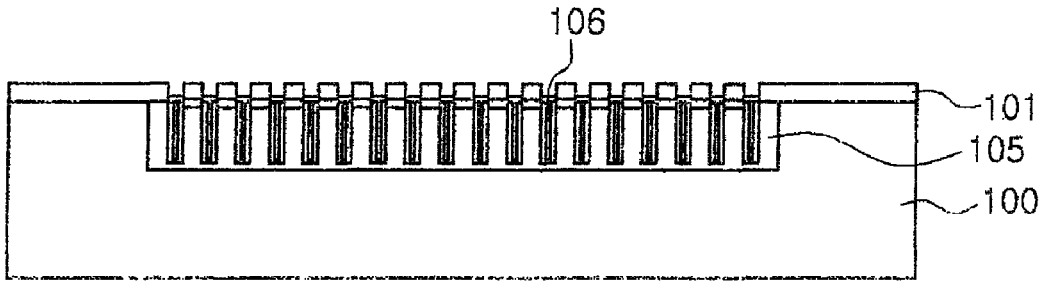
Figure 4E:
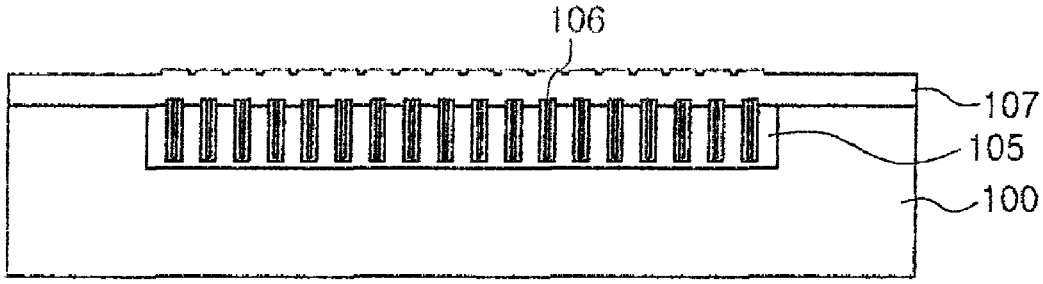
Figure 4F:
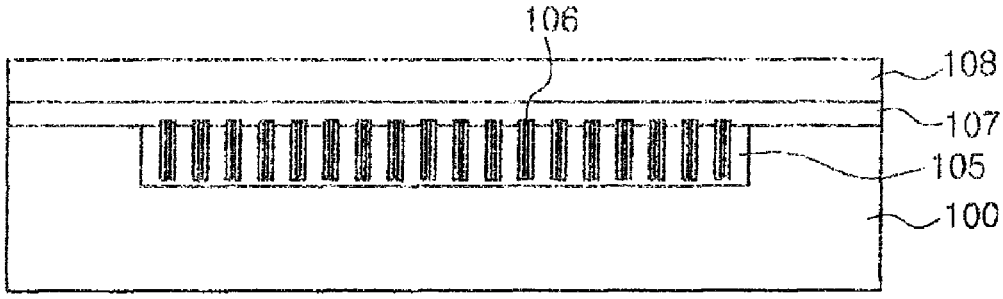
Figure 4G:
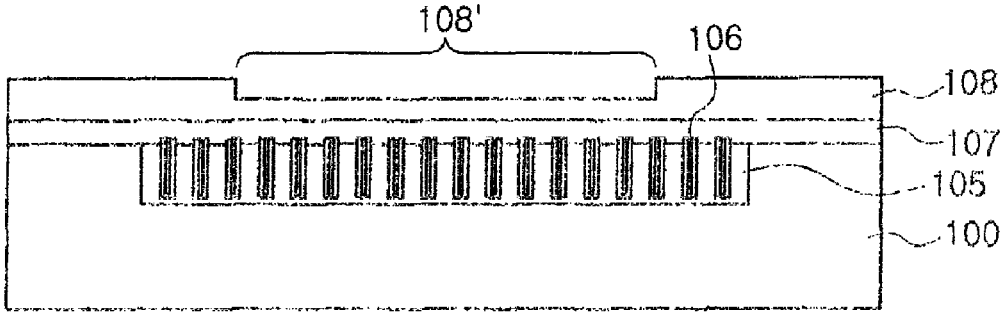
Figure 4H:
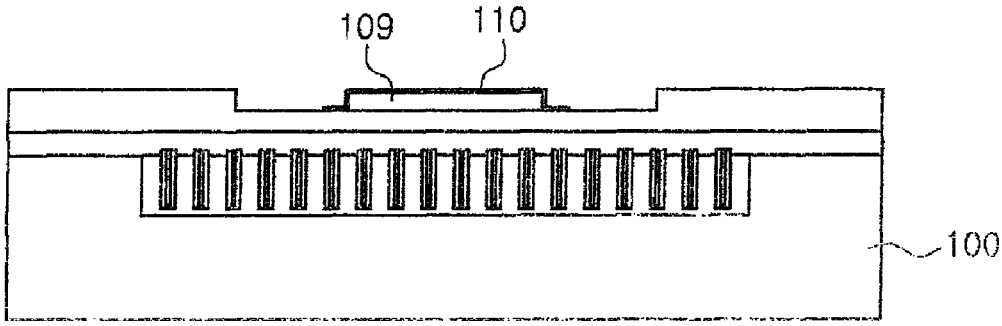
Figure 4I:
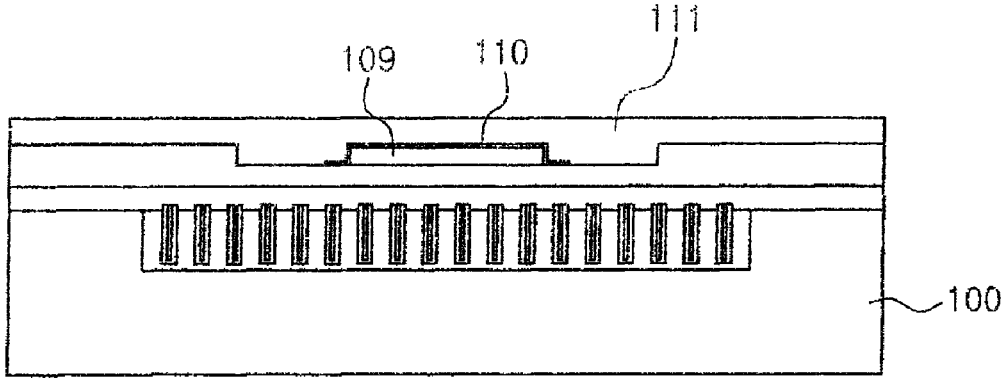
Figure 4J:
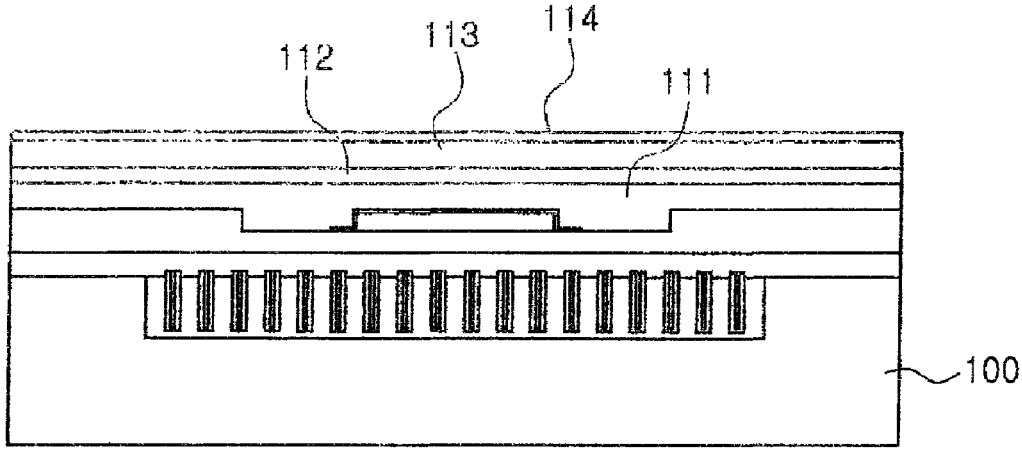
Figure 4K:
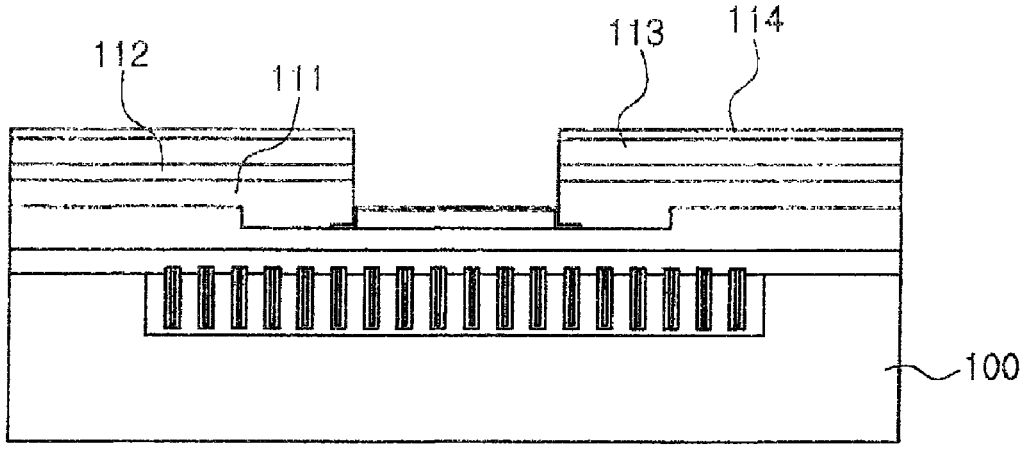
Figure 4L:
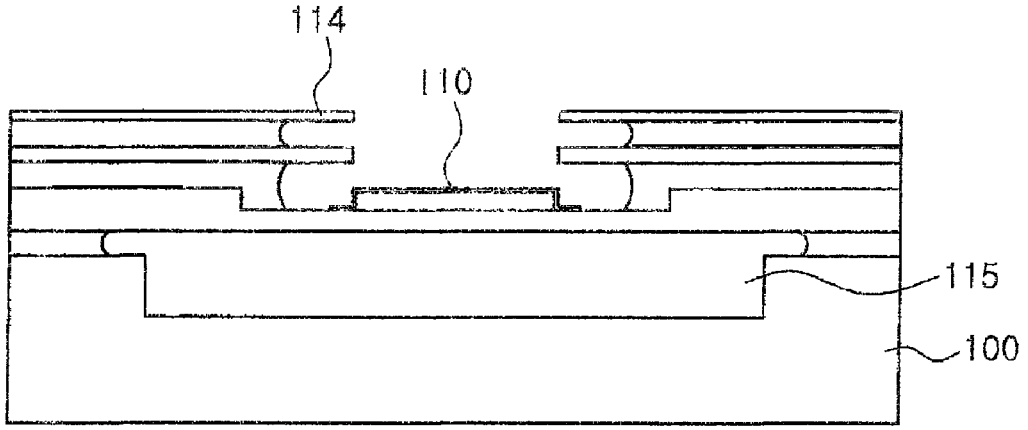
Figure 4M:
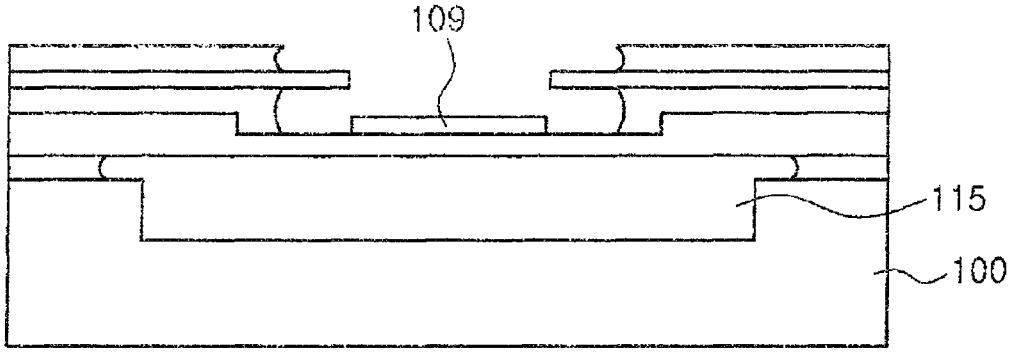
Figure 4N:
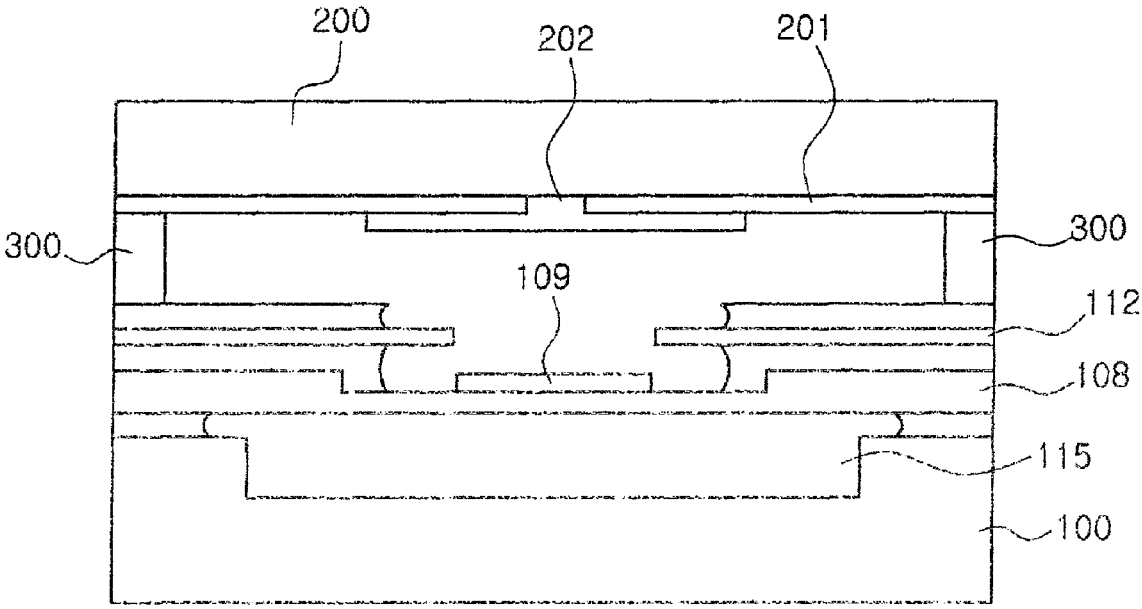

FIGS. 4A through 4N are cross-sectional views for explaining a process of manufacturing a vacuum channel transistor, according to an exemplary embodiment of the present invention.

A method of manufacturing a vacuum channel transistor, according to an exemplary embodiment of the present invention includes forming an anode layer on a bottom surface of an upper substrate to form an upper structure; forming a cathode layer and a gate layer to be spaced apart from a top surface of a lower substrate to form a lower structure; forming a cavity between the lower substrate and the cathode layer; and coupling the upper structure and the lower substrate together to be spaced apart from each other.

Additionally, the method of manufacturing a vacuum channel transistor, according to an exemplary embodiment of the present invention may further include at least one of operations of etching a portion of the cathode layer to form a local-heating microelectrode part forming a step with the cathode layer; forming a heat resistant layer formed of a material having a low work function on the cathode layer; and forming one or more control gate layers on the gate layer to be spaced apart from each other.

First, the upper structure in which the anode layer 202 is formed under the upper substrate 200 is formed. The cross-sectional view of FIG. 4A corresponds to a process of forming the upper structure.

As shown in FIG. 4A, an insulating layer 201 having a thickness of about 1 um to about 2 um is formed on a highly doped upper substrate 200. The insulating layer 201 may be a thermal oxide layer or a low-temperature oxide layer. A portion of the insulating layer 201 is patterned by using a lithographic process such that the upper substrate 200 can be connected to an anode layer 202 to be formed later. Thereafter, nickel (Ni) is stacked at a thickness of about 2.0 um by using a sputtering or deposition process, and a lithographic process is performed thereon to form the anode layer 202. Thus, the upper structure is formed.

Thereafter, a cathode layer and a gate layer are formed to be spaced apart from a top surface of a lower substrate, and a cavity is formed between the lower substrate and the cathode layer, thereby forming the lower structure. Additionally, a portion of the cathode layer may be etched to form a local-heating microelectrode part forming a step with the cathode layer, and a heat resistant layer formed of a material having a low work function may be formed on the cathode layer. The cross-sectional views of FIGS. 4B through 4M correspond to a process of forming the lower structure.

As shown in FIG. 4B, a silicon nitride layer 101 and a silicon oxide layer 102 are sequentially formed on the lower substrate 100. A photosensitive layer 103 is applied on the silicon oxide layer 102 and is exposed by using a first mask, and then patterning is performed thereon to define a portion for a trench array to be formed. The silicon nitride layer 101 is used as a thermal oxidation-resistant layer in a subsequent process, and the silicon oxide layer 102 serves to prevent the silicon nitride layer 101 from being etched. The silicon nitride layer 101 and the silicon oxide layer 102 are formed using low pressure chemical vapor deposition (LPCVD) or plasma enhanced chemical vapor deposition (PECVD).

Thereafter, as shown in FIG. 4C, the silicon oxide layer 102 exposed through the patterning and the silicon nitride layer under the silicon oxide layer 102 are sequentially dry-etched, and then the photosensitive layer 103 is removed. Thereafter, the exposed lower substrate 100 is dry-etched to a depth ranging from about 1 μm to about 20 μm, using reactive ion etching (RIE) or deep RIE, thereby forming a trench array 104. Thereafter, the lower substrate 100 may be doped with $n^+$ impurities by diffusing $POCl_3$ in a furnace at about 900° C. for about 30 minutes, so that a thermal oxidation rate of the trench array 104 becomes higher in a subsequent process (see FIG. 4D) and a thermal oxide sacrificial layer 105 containing phosphorus (P) is easily removed by HF etching (see FIG. 4L). A dimension ratio of an interval to width of a trench line width portion is made to be 0.45:>0.55 so that fine pores 106 are formed in the thermal oxide sacrificial layer 105 generated using a silicon thermal oxidation process. This serves to prevent a trench from being completely filled with an oxide layer as silicon is oxidized and thus increases in volume.

Thereafter, as shown in FIG. 4D, the silicon oxide layer 102 and etch residues are removed by wet etching in a 6:1 BHF solution. Thereafter, a thermal oxidation process is performed using the silicon nitride layer 101 as an oxidation mask in a furnace at a temperature ranging from about 900° C. to about 1000° C. under $O_2$ or $H_2/O_2$ atmosphere, thereby forming the thermal oxide sacrificial layer 105 containing P at the trench array 104 and around the trench array 104. The thermal oxide sacrificial layer 105 formed as above defines an area for a cavity 115 having a dimension or size of about 1 μm to about 100 μm. A plurality of fine pores 106 each having a width of about 0.1 μm to about 0.3 μm are formed in the thermal oxide sacrificial layer 105. The fine pores 106 each serve as a fine capillary tube facilitating infiltration of a wet etching solution or a gas-phase etching gas when the thermal oxide sacrificial layer 105 is removed in a subsequent process (see FIG. 4L).

As shown in FIG. 4E, the silicon nitride layer 101 is removed using a phosphoric acid ($H_3PO_4$) solution. Thereafter, a low temperature silicon oxide ($SiO_2$) sacrificial layer 107 having a thickness ranging from about 1.0 μm to about 2.0 μm is formed using LPCVD.

As shown in FIG. 4F, in order to reduce roughness of a surface, the low temperature silicon oxide sacrificial layer 107 is polished and planarized at a thickness of about 0.1 μm to about 1.0 μm by using a chemical mechanical polishing method. Thereafter, a polishing agent is removed, a washing process is performed, and then polysilicon is deposited at a thickness of about 4.0 μm to about 5.0 μm, using LPCVD, thereby forming a cathode layer 108. Thereafter, post-annealing is performed in a furnace at a temperature of 500° C. under $N_2$ atmosphere for two hours, thereby reducing compressive stress.

As shown in FIG. 4G, to use a portion of the cathode layer 108 as a local-heating microelectrode part 108', a portion of the cathode layer 108 deposited at a thickness of about 4.0 μm to about 5.0 μm is thinned to a thickness of about 2.0 μm to about 3.0 μm. To this end, the portion for the local-heating microelectrode part 108' is patterned using photoresist, moisture remaining on a surface is removed by performing heating in a furnace at a temperature of about 450° C. under $N_2$ atmosphere for thirty minutes or longer, and then the cathode layer 108 is dry-etched. The cathode layer 108 may be formed of polysilicon doped to have a resistance of about 10 Ω/square in order to use the portion of the cathode layer 108 as the local-heating microelectrode part 108'.

As shown in FIG. 4H, a heat resistant layer 109 formed of a material having a low work function is formed on the local-heating microelectrode part 108' of the cathode layer 108. To this end, a material of a low work function is deposited at a thickness of about 300 nm to about 3000 nm using PECVD. Examples of the material having the low work function include diamond or DLC which is carbon-based and barium oxide. Preferably, the heat resistant layer 109 is formed of DLC. Since it is difficult to remove DLC or diamond carbon using dry or wet etching after resist patterning, DLC or diamond carbon is formed by lift-off patterning. Thereafter, for example, at least one layer of an insulating material such as a silicon nitride layer is deposited at a thickness of about 100 nm to about 200 nm and then is removed by using lithographic patterning, except for a portion thereof surrounding the heat resistant layer 109, thereby forming a first passivation layer 110.

As shown in FIG. 4I, a low temperature silicon oxide ($SiO_2$) layer having a thickness of about 2.0 μm to about 3.0 μm is deposited using LPCVD, thereby forming a first insulating layer 111.

As shown in FIG. 4J, doped polysilicon with a thickness of about 2.0 μm to about 3.0 μm is deposited on the first insulating layer 111 using LPCVD, thereby forming a gate layer 112. Thereafter, a second insulating layer 113 is formed on the gate layer 112, and a low temperature nitride layer having a thickness of about 100 nm to about 200 nm is deposited on the second insulating layer 113 using PECVD, thereby forming a second passivation layer 114.

As shown in FIG. 4K, a photoresist layer is applied on the second passivation layer 114 and exposed using a mask, and patterning is performed thereon to define a portion for an opening at an upper end of an area in which the local-heating microelectrode part 108', the heat resistant layer 109 and the gate layer 112 are sequentially stacked. An opening portion is formed in the second passivation layer 114 by dry or wet etching, and then the photoresist layer is removed. Thereafter, the second insulating layer 113, the gate layer 112 and the first insulating layer 111 are sequentially removed by anisotropic dry etching until the first passivation layer 110 on the heat resistant layer 109 is exposed through an opening.

As shown in FIG. 4L, the thermal oxide sacrificial layer 105 and the silicon oxide sacrificial layer 107 are removed to form a cavity 115, and the first and second insulating layers 111 and 113 surrounding the opening are etched so that the first passivation layer 110 exposed through the opening is completely exposed.

Specifically, an etch hole is formed to introduce a wet etching solution or a gas-phase etching gas for removing the thermal oxide sacrificial layer 105 and the silicon oxide sacrificial layer 107 to the sacrificial layers 105 and 107. To this end, a thick photoresist layer is applied on the second passivation layer 114, and exposure is performed using the photoresist layer as a mask. Thereafter, patterning is performed to define a portion for an etch hole to be formed. The etch hole may be formed to penetrate the cavity 115 at a portion excluding the opening area. Thereafter, the second passivation layer 114, the second insulating layer 113, the gate layer 112, the first insulating layer 111 and the first passivation layer 110 are sequentially dry-etched, thereby forming a plurality of etch holes.

Thereafter, wet etching or gas-phase etching is performed to remove the thermal oxide sacrificial layer 105 and the silicon oxide sacrificial layer 107. At this time, an etching solution is easily infiltrated up to a lower portion of the thermal oxide sacrificial layer 105 due to a capillary force caused by the fine pores 106 formed in the thermal oxide sacrificial layer 105. When the gas-phase etching is performed, the lower substrate 100 is put into gas phase etching (GPE) equipment. Then, a temperature of the substrate is controlled within a range from about 22° C. to about 35° C., the pressure of a reaction furnace is controlled within a range from about 10 Torr and about 100 Torr, and then anhydrous HF and $CH_3OH$ gas are introduced thereto. Accordingly, the thermal oxide sacrificial layer 105 and the silicon oxide sacrificial layer 107 are removed by a HF etching reaction in a gas phase. Better etching results may be obtained by combining the wet etching and gas-phase etching methods in etching the sacrificial layers 105 and 107. Also, the etching time can be shortened by increasing a width of the fine pores 106 or increasing the etch hole in size or number.

As mentioned above, the cavity 115 surrounded by the lower substrate 100, the cathode layer 108 and the remaining silicon oxide sacrificial layer 107 is formed by removing the thermal oxide sacrificial layer 105 and the silicon oxide sacrificial layer 107 using the wet etching or gas-phase etching.

Thereafter, a photoresist material remaining in an opening region is removed, and then the first and second insulating layers 111 and 113 are etched using wet etching to completely expose the first passivation layer 110 exposed through the opening.

As shown in FIG. 4M, the first and second passivation layers 110 and 114 serving as masks in the preceding operations are removed using a phosphoric acid ($H_3PO_4$) solution and a resulting structure is washed with pure water (DI water), thereby manufacturing a lower structure of the vacuum channel transistor according to the current embodiment of the present invention.

Thereafter, as shown in FIG. 4N, the lower structure and the upper structure are coupled together, spaced apart from each other at a predetermined interval by a spacer 300. The upper structure and the lower structure are aligned such that a central portion of the anode layer 202 of the upper structure faces a central portion of the gate layer 112 of the lower structure. Also, the height of the spacer 300 may be properly controlled according to a characteristic of the vacuum channel transistor, and insulating polyimide or a Ni-electro-plated spacer may be used for the spacer 300.

In the vacuum channel transistor according to embodiments of the present invention, electrons can be emitted even when a low voltage is applied to a gate layer, a voltage of an anode layer has a small influence on electron emission of a cathode layer, and instability of emission current is obviated to secure operational stability. Accordingly, the high efficiency and a long lifespan of the vacuum channel transistor can be realized.

While the present invention has been shown and described in connection with the exemplary embodiments, it will be apparent to those skilled in the art that modifications and variations can be made without departing from the spirit and scope of the invention as defined by the appended claims.

What is claimed is:

1. A vacuum channel transistor comprising:

an upper structure comprising an anode layer disposed on a bottom surface of an upper substrate; and a lower structure comprising a cathode layer and a gate layer spaced apart from a top surface of a lower substrate, and a cavity provided between the lower substrate and the cathode layer, the cathode layer being formed of a material having a low work function, wherein the cathode layer has a lower surface facing the top surface of the lower substrate and an upper surface opposite to the lower surface, and the gate layer is disposed on the upper surface of the cathode layer, and wherein the cathode layer has a first thickness in a first region and a second thickness in a second region, the second thickness being smaller than the first thickness, the second region being surrounded by the first region and being connected to the first region without discontinuity.

2. The vacuum channel transistor of claim 1, further comprising a spacer supporting the upper structure and the lower structure to be spaced apart from each other.

3. The vacuum channel transistor of claim 1, wherein the second region of the cathode layer is a local-heating microelectrode part, and wherein an upper surface of the second region is disposed at a level lower than a level at which an upper surface of the first region is disposed, and wherein the upper surface of the first region, the upper surface of the second region, and a side face of the first region bridging the upper surface of the first region to the upper surface of the second region collectively form a step shape.

4. The vacuum channel transistor of claim 3, wherein the local-heating microelectrode part has a structure in which grooves are recessed alternately from one side and from the other side.

5. The vacuum channel transistor of claim 1, further comprising a heat resistant layer formed of a material having a low work function on the cathode layer.

6. The vacuum channel transistor of claim 1, wherein the material having a low work function is one selected from the group consisting of diamond, diamond-like carbon (DLC) and barium oxide.

7. The vacuum channel transistor of claim 1, further comprising at least one control gate layer spaced apart from a top portion of the gate layer.

8. A vacuum channel transistor comprising:

an upper structure comprising an anode layer disposed on a bottom surface of an upper substrate; and a lower structure comprising a cathode layer and a gate layer spaced apart from a top surface of a lower substrate, a cavity provided between the lower substrate and the cathode layer, and a heat release layer formed of a material having a low work function on the cathode layer, wherein the cathode layer has a lower surface facing the top surface of the lower substrate and an upper surface opposite to the lower surface, and the gate layer is disposed on the upper surface of the cathode layer, and wherein the cathode layer has a first thickness in a first region and a second thickness in a second region, the second thickness being smaller than the first thickness, the second region being surrounded by the first region and being connected to the first region without discontinuity.

9. The vacuum channel transistor of claim 8, further comprising a spacer supporting the upper structure and the lower structure to be spaced apart from each other.

10. The vacuum channel transistor of claim 8, wherein the second region of the cathode layer is a local-heating microelectrode part, and wherein an upper surface of the second region is disposed at a level lower than a level at which an upper surface of the first region is disposed, and wherein the upper surface of the first region, the upper surface of the second region, and a side face of the first region bridging the upper surface of the first region to the upper surface of the second region collectively form a step shape.

11. The vacuum channel transistor of claim 10, wherein the local-heating microelectrode part has a structure in which grooves are recessed alternately from one side and from the other side.

12. The vacuum channel transistor of claim 8, wherein the material having a low work function is one selected from the group consisting of diamond, diamond-like carbon (DLC) and barium oxide.

13. The vacuum channel transistor of claim 8, further comprising at least one control gate layer spaced apart from a top portion of the gate layer.

* * * * *